United States Patent [19]

Langhammer

[11] Patent Number: 4,475,581

[45] Date of Patent: Oct. 9, 1984

[54] METHOD AND APPARATUS FOR FABRICATING GLAD INGOTS

[75] Inventor: Hans-Jürgen Langhammer, Ritterhude, Fed. Rep. of Germany

[73] Assignee: Klöckner-Werke AG, Duisburg, Fed. Rep. of Germany

[21] Appl. No.: 341,268

[22] Filed: Jan. 21, 1982

[30] Foreign Application Priority Data

Jan. 31, 1981 [DE] Fed. Rep. of Germany ..... 3103240
Mar. 13, 1981 [DE] Fed. Rep. of Germany ..... 3109602

[51] Int. Cl.[3] ..... B22D 19/00
[52] U.S. Cl. ..... 164/100; 164/108
[58] Field of Search ..... 164/100–101, 164/108, 110, 353, 356, 92.1, 112

[56] References Cited

U.S. PATENT DOCUMENTS

| | | | |
|---|---|---|---|
| 976,456 | 11/1910 | Grey et al. | 164/101 |
| 2,235,200 | 3/1941 | Chace | 164/112 |
| 3,364,976 | 1/1968 | Reding et al. | 164/98 |
| 3,856,076 | 12/1974 | Adams et al. | 164/92.1 |
| 4,102,033 | 7/1978 | Emi et al. | 164/100 |

FOREIGN PATENT DOCUMENTS

| | | |
|---|---|---|
| 736672 | 6/1943 | Fed. Rep. of Germany . |
| 2333359 | 1/1975 | Fed. Rep. of Germany . |

*Primary Examiner*—Kuang Y. Lin
*Assistant Examiner*—Richard K. Seidel
*Attorney, Agent, or Firm*—Watson, Cole, Grindle & Watson

[57] ABSTRACT

A method of and apparatus for fabricating clad ingots or clad slabs includes a hollow body which corresponds to the dimensions of a finished slab and which has at least one side plate of cladding material and other thinner side sheets forming an upright tubular hollow body which is inserted into a larger ingot mold. Refractory insulating material is disposed between the bottom end of the hollow body and the bottom wall of the mold and between the sides of the hollow body and the sides of the mold, the hollow body being subsequently charged with a molten base metal. Prior to inserting the hollow body into the mold, the bottom end thereof is sealed closed by a bottom wall and a cover plate is placed on the top end of the hollow body.

14 Claims, 6 Drawing Figures

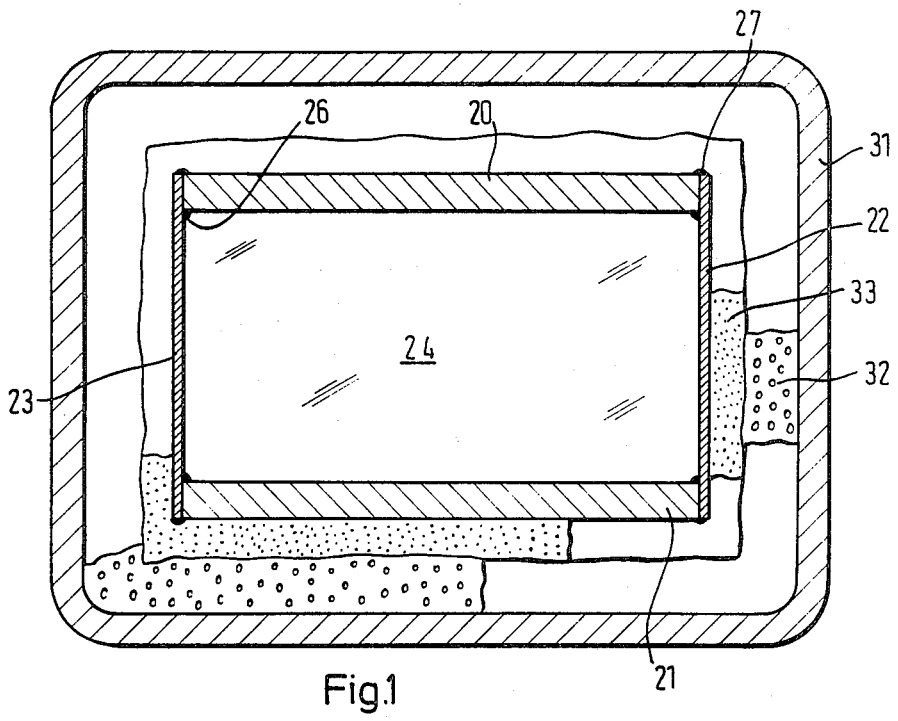
Fig.1
Fig. 2
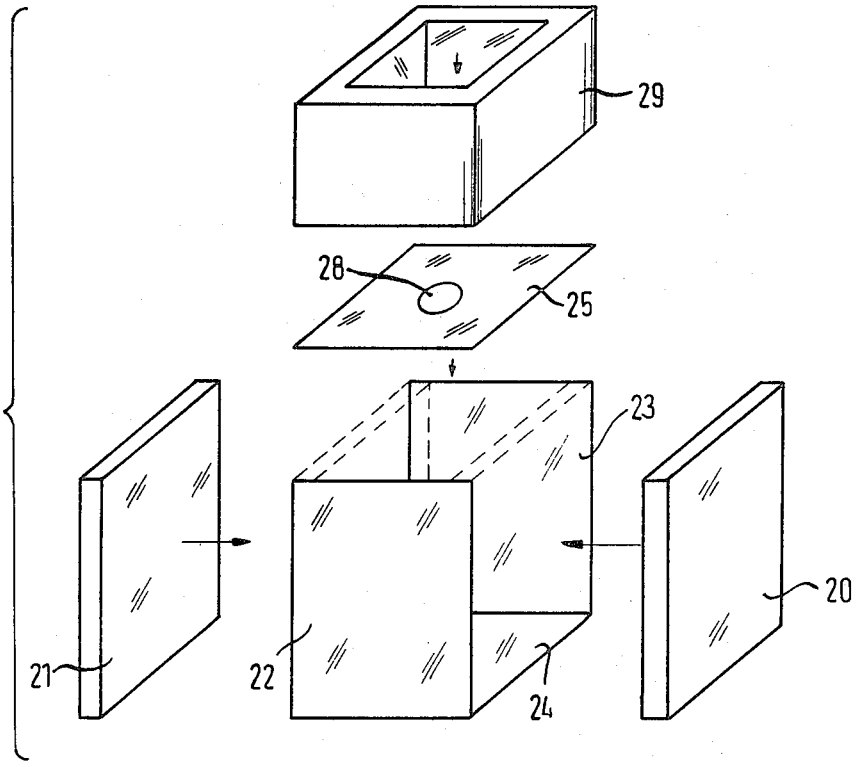

METHOD AND APPARATUS FOR FABRICATING GLAD INGOTS

BACKGROUND OF THE INVENTION

This invention relates generally to a method of fabricating clad metal ingots, more particularly clad slabs, in which a hollow body corresponding to the dimensions of the finished slab is in the form of a parallelepiped having at least one metal side plate of cladding material and thinner, metal side sheets. The body is inserted into an ingot mold or surface chill, a layer of fine-grained refractory insulating material fills the space between the bottom of the mold and the bottom of the hollow body as well as between the sides of the mold and the sides of the body, and the body is then charged with a molten base metal. The invention further relates to a hollow body for carrying out the method.

A method is disclosed in German Pat. No. 736 672 for weld or melt cladding, but the desired holohedral welding is not achieved during casting. If, during the charging of this known hollow body, the molten base metal is not extremely superheated, the very thick side plates of cladding material thereof function as a mold wall. During cooling and shrinking, the cast slab is permitted to set as a block in the mold at such a distance from the side plates as to form gaps. These gaps increase in size because the side plates, in turn, are heated unilaterally by the molten steel, thereby causing them to bulge outwardly and to warp like a pillow.

During cooling of the hollow body charged with the base metal in the surface chill and during reheating in the preheating furnace, the shrinking and expansion tendencies of the cooling base metal (standard steel) and of the cladding material (generally special steel) cause the gaps to increase in size. The gaps open at their terminal ends are accessible to the atmosphere which can penetrate between the cladding material and the base metal. This causes the interfaces thereof to oxidize, which oxidation is promoted by the elevated temperature. Thus, the bond between the cladding material and the base metal effected during the subsequent rolling operation weakens because of the formation of oxidation layers.

Normally, because of the very high thermal capacity of the side plates in comparison to the base metal, intimate bonding of cladding material and base metal resulting from integral casting can only be achieved with great difficulty and is only made possible by superheating the base metal. Due to the difference in heat dissipation there is less detachment between the cladding material and the base metal near the edges thereof as compared to the central portion. The base metal nevertheless contaminates as the result of the detachment of the cladding. Contamination of the base metal with Cr, Ni, C or Mn are completely unacceptable, even if there is only little detachment. Moreover, the cladding in this case is thinner and uneven.

To insure an adequately thick layer of coating material after the finished rolling of the plated slab in a subsequent operation, the thickness of the side plate cladding material usually amounts to 3 to 15% of the total thickness of the plated slab. In the method disclosed in German Pat. No. 736 672, this thickness ratio is even more likely greater than the upper limit indicated. However, with such a mass ratio, adequate heating and fusing of the initially normally tempered side plates by means of the heat content of the molten base metal, can only be achieved with difficulty.

When casting molten steel between two cladding sheets, it is assured than an intimate bond is made immediately following the casting by fusing the cladding material of the side plates. If superheated steel is employed, i.e., steel being cast at high temperatures, it has proven to be difficult in practice to adjust the temperature and the thicknesses of the material of the hollow body to one another in such a manner as to avoid dissolution of detachment during quenching. The side sheets, that is, the side faces of the hollow body not including the cladding material, would detach in accordance with German Pat. No. 736 672, because of their thinness. Moreover, superheating of the base metal requires a great deal of energy.

Furthermore, a method of producing clad ingots is disclosed in German Pat. No. 2 333 359, commonly owned herewith, in which cladding sheets are placed in a mold close to the walls thereof with the narrow side faces remaining freely accessible. During subsequent casting, these narrow side faces are intimately bonded with the base metal through heat shrinking and without dissolution, so that they provide a surface-side seal when the gap between the cladding sheet and the base metal develops.

However, this prior method is only suitable for relatively thick cladding sheets because of the amount of the desired sealing, i.e., the sealing through heat shrinking between the narrow side faces of the cladding sheets and the base metal is dependent upon the surface area of these narrow side faces and is improved as this area increases in size. However, since the coating material is clearly more costly than the base metal thereby giving rise to a minimization of the constituent amount of cladding material, this prior method has rarely been employed in the case of thin cladding plates. Moreover, it utilizes a great deal of energy.

SUMMARY OF THE INVENTION

It is therefore an object of the present invention to overcome the drawbacks of the prior methods and to improve upon the process of clad ingots as aforedescribed in such a manner as to prevent the formation of an open gap between the cladding material and the base metal which gap is accessible to the atmosphere so that, during the subsequent rolling operation, an adequate bond can be formed between the materials and energy can be saved.

This general objective is achieved in that, prior to introducing the hollow body into the slab mold, the bottom end of the hollow body is sealed closed by a bottom wall, and a cover plate is placed on the top end of the hollow body.

By using the bottom wall and cover plate, the gap between the cladding material and the base metal is rendered inaccessible to the atmosphere. As a result, the interfaces thereof cannot oxidize and the bond between both materials resulting from subsequent rolling is not impaired.

Further in accordance with the invention the refractory insulating material between the bottom end of the hollow body and the bottom end of the ingot mold, and between the sides of the body and the sides of the mold, is thermally insulated by the provision of permanent insulating layer which lines the inner surfaces of the mold. Thus, the base metal cast into the hollow body solidifies relatively slowly and substantially more slowly than normal gravity die casting. The heat dissipation can largely be controlled through the insulation.

A still further object according to the invention is to provide such a method wherein the cover plate has a filling gate, and a hood of insulating material overlies the cover to enable the filling gate to be filled with the molten metal during the casting, and to further maintain a portion of the base metal on top of the cover plate molten sufficiently long to permit the formation of a sink hole beneath the gate.

Other objects, advantages and novel features of the invention will become more apparent from the following detailed description of the invention when taken in conjunction with the accompanying drawings.

BRIEF DESCRIPTION OF THE DRAWINGS

FIG. 1 is a sectional view of a hollow body according to the invention disposed in a slab mold;

FIG. 2 is an expanded perspective view of the hollow body of FIG. 1 together with a hood;

DETAILED DESCRIPTION OF THE INVENTION

Figure 3:
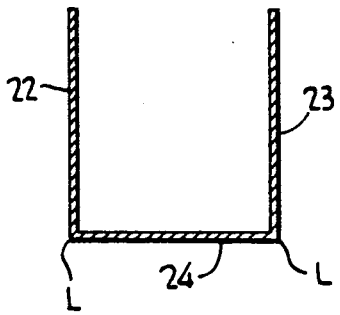
FIGS. 3 and 4 are sectional views of two different constructions of side and bottom sheets forming a portion of the hollow body.
Figure 4:
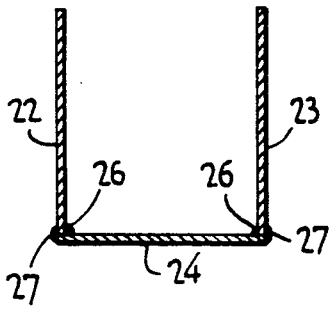

Turning now to the drawings wherein like reference characters refer to like and corresponding parts throughout the several views, the hollow body shown in FIGS. 1 and 2 serving as a mold comprises a pair of opposing side plates 20 and 21 of cladding material, a pair of opposing side sheets 22 and 23, a bottom plate 24 and a cover plate 25, all of a suitable metal and forming a parallelepiped. It should be noted that, without departing from the invention, only one side plate 20 or 21 of cladding material may be utilized to form the hollow body. The thickness of the cladding material is greater than that of sheets 22, 23, 24 and 25, and the opposing side sheets 22, 23 as well as the opposing top and bottom plates 25, 24 are respectively of substantially the same size. As shown in FIGS. 2 and 3 sheets 22, 23 and bottom plate 24 may be formed of a single strip bent along a pair of spaced bend lines L to form a substantially U-shaped section. Otherwise, the opposing side sheets 22, 23 and bottom plate 24 may be welded together as at 26 and 27 shown in FIG. 4.

As illustrated by the dashed lines in FIG. 2, side plates 20 and 21 are inserted in the U-shaped section thus formed and are welded thereto as at 26 and 27 shown in FIG. 1. Cover plate 25 is welded in place along its marginal edge, and includes a filling gate 28 of known construction.

Prior to casting, a hood 29 of insulating material is disposed on top of cover plate 25. It enables the filling gate 28 to be filled during casting and, due to its insulating walls, it maintains that portion of the base metal molten on top of the cover plate sufficiently long to permit a sink hole (not shown) thereby formed beneath the filling gate to be filled.

Figure 5:
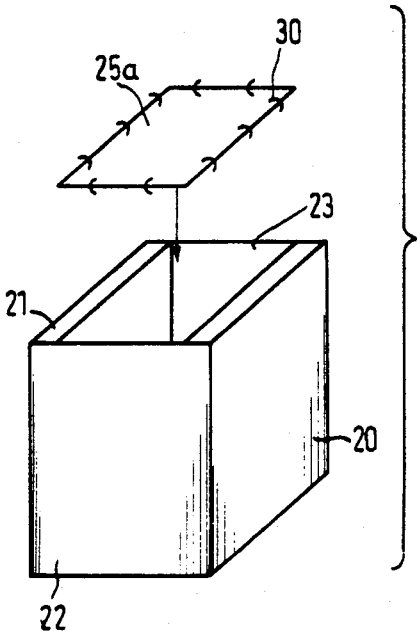
FIG. 5 is an expanded perspective view of another embodiment of a hollow body according to the invention.
Figure 6:
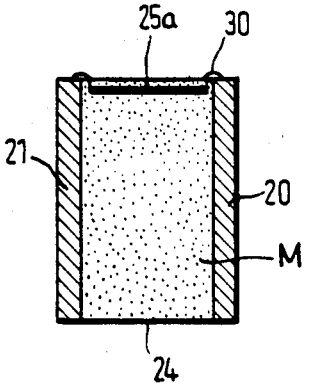
FIG. 6 is a vertical sectional view of the hollow body of FIG. 5 shown after casting.

Instead of a hollow body with cover plate 25 welded on for casting, as shown in FIG. 2, a modified cover plate 25*a* may be provided as in FIGS. 5 and 6. As can be seen, this cover plate 25*a* is smaller than cover plate 25 and fits with adequate clearance into the hollow body of FIG. 6. Cover plate 25*a* is provided with hangers 30 designed in such a manner that the cover plate is supported several centimeters beneath the upper edge of the hollow body.

Cover plate 25*a* of FIGS. 5 and 6 is disposed on the surface of the molten base metal M after casting. A certain amount of the molten base metal wells up through the gaps formed between the marginal edges of the cover plate and side plates, 20, 21 or side sheets 22, 23, as the case may be, thereby insuring a reliable sealing without requiring the cover plate to be welded on prior to casting, as in FIGS. 1, and 2.

The hollow body shown in FIG. 1 is surrounded on all sides, including its bottom end, by two layers of refractory insulating material which fill the gap between the hollow body and the inner surface of an external ingot mold 31 commonly referred to as a surface chill. Outer layer 32 comprises a permanent lining of lightweight refractory bricks or asbestos plates, and inner layer 33 comprises sand. This inner layer is removed after each individual casting operation and is again provided between insulating layer 32 and the hollow body in readiness for a subsequent casting operation.

After removal of the hollow body cast with the molten base metal, inner layer 33 falls to the bottom of mold 31, and some of the lightweight refractory bricks or asbestos plates likewise fall into pieces. This free-flowing insulating material is removed from the surface chill such as through a flap provided in the bottom thereof, and is thereby available for re-use.

As apparent from the drawings, sheets 22 to 25 are substantially thinner than that of side plates 20 and 21. The wall thickness of the side plates is about from 3 to 15%, preferably from 3 to 10%, of the corresponding thickness of the hollow body forming the finished slab. The thickness of the refractory insulating layer is chosen in accordance with the properties of the materials employed, such that the cooling of the charged molten metal is sufficiently slow and the homogenization thereof is satisfactory. Total thickness of the refractory insulating material of 50 cm and more are required.

From the foregoing, it can be seen that, by using the cover and bottom plates according to the invention, any gaps between the cladding material and the base metal are prevented from having free access to the atmosphere. As a result, the surfaces at the gaps cannot oxidize and the bond between both materials resulting from subsequent rolling will not be impaired. In the method embodying the principles of the invention, the side plates bend outwardly like a pillow during casting, but remain bonded on the surface side with the side sheets, the bottom plate, and the cover plate, so that no open gaps are formed.

In contrast to simple roll cladding, a special construction of the side plate facing the base metal is not necessary. In particular, this surface is not completely flat. During casting, the base metal fills all irregularities of the side plate and forms an impression thereof during the subsequent shrinkage. Therefore, the shapes of the side plate and of the base metal are matched to one another for bonding which takes place during the subsequent rolling operation.

However, it is a particular advantage of the method according to the invention that the solidified clad ingot be rolled hot, preferably at the highest possible rolling temperature, in order to save energy. The plated slabs can be finish-rolled by the use of heat which is still available, without the need for intermediate heating. On balance, this results in considerable savings of energy, because it dispenses with the need to reheat the ingots in order to bring them to the rolling temperature.

Because inner layer 33 of the refractory insulating material is thermally insulated by permanent outer layer 32 of insulating material, the base metal solidifies relatively slowing and substantially more slowly than in normal gravity die casting. The heat dissipation can largely be controlled through the insulation. The ingot can therefore be very gradually brought closer to the desired rolling temperature or can be maintained for hours at an elevated temperature range which is adequate for rolling. This avoids the need for reheating even with the delays caused by bottlenecks in the mill train, during an outage therein, or if certain transport paths exist to the mill train. Thus, there are adequate time and temperature reserves for the drawing of the clad ingots during the rolling operation.

While basically bottom plate 24 is seal-welded at the surface side thereof on the bottom end of the hollow body, cover plate 25 can be seal-welded likewise on its surface side, either on the top end of the hollow body, in which case the cover plate has a filling gate 28, or the cover plate 25*a* is placed on the surface of the molten base metal M after the hollow body has been cast with the base metal. Since the cover plate, as all the other plates other than the cladding material forming the hollow body, has a minimum wall thickness and is only so thick that it not become detached, intimate bonding of the cover plate and of the other plates with the base metal can be achieved during casting. The relatively thin plates offer very little resistance to the shrinking motion of the ingot from the base metal so that no gaps are formed.

The bottom and cover plates may be convexly bent to enable material to be added at areas of the clad ingot which normally show area reductions during rolling, thereby increasing the portion of the clad ingot that can be utilized.

Particularly for a cover plate such as 25 which is welded on prior to casting and which is provided with a filling gate, it is advantageous to dispose a hood such as 29 of insulating material on the hollow body or on the cover plate, and to pour the molten base metal over the hood during casting. The quantity of base metal on the top of the cover plate fills a shrink hole formed beneath the filling gate. To effect this, the area at the sides of and above the hood should be more insulated than the remainder of the bottom area.

If the cover plate such as 25*a* is not placed on the surface of the molten base metal until the hollow body has been filled therewith, a shrink hole is formed, although not filled, and will remain closed off due to the cover plate, particularly against atmospheric influences.

The wall thickness of the side plate or plates of cladding material range from about 3 to 15% of the corresponding thickness of the slab. In such manner, adequately thick cladding is obtained even for finely rolled-out sheets.

The wall thickness of the side sheets 22, 23, bottom plate 24 and cover plate 25 is adjusted to the superheat of the slab. Suitable cast coatings on the inner surfaces thereof as well as on the inner surfaces of plates 20 and 21, and further measures, will insure that they do not slag, scale or oxidize during casting. The side sheets may have a wall thickness of from 0.2 to 2.0% of the largest cross-sectional side of the slab.

In order to prevent heat from being dissipated upwardly after the base metal has been cast, the top end of the hollow body may be covered with a layer of refractory insulating material after casting. The thickness of such layer, as the thickness of the side and bottom layers 32 and 33, is adjusted to the parameters of the specific casting process. In particular, the specific heat conductivity of the insulating means, the heat capacity thereof, including that of the surrounding mold slab, and the heat content of the base metal, should be taken into account. The object is to adjust the heat dissipation in such a manner that the normal rolling temperatures of 1100° C. to 1450° C. can be adjusted with unerring precision.

Free-flowing sand is particularly suitable as a refractory insulating material because it is readily available at low cost. Slag sand, fire clay, alumina and other, free-flowing, refractory, random fills may likewise be employed. The only criteria is that the melting and sintering temperatures be in excess of 1500° C. or about 1800 K. The thickness of layer 33 ranges from about 5 to 50% of the largest cross-sectional side of the slab. And, a light, side thrust via compaction may be exerted on the side sheets and the side plates through the insulating material so as to prevent a gap from developing between the insulating material and the outer surface of the hollow body.

To prevent the outer surfaces of the hollow body from scaling, a quantity of fine coal of up to 1.0% by weight may be added to the insulating material, or the top of the insulating material may be covered with a carbonaceous insulating powder.

Although the entire space between the surface chill and the hollow body is normally filled with fine-grained refractory insulating material, it is advantageous according to the invention to provide layers of insulating material such as 32 and 33 between the hollow body and the slab mold so as to provide a permanent outer insulating layer 32 for thermally insulating layer 33. Thus, the fine-grained, inner refractory insulating layer 33 only comes into direct contact with the hollow body. Such an arrangement also produces savings in time and lavor. And, furthermore, with this double layer of insulating material, the casting temperature can be minimized because, owing to the insulation, any premature solidification is substantially avoided. Due to the slow chilling, considerable homogenization of the base metal is achieved. At the same time, the base metal can be alloyed while still in the hollow mold because of this slow chilling aspect, when the alloying material is added at a specified superheat temperature. The smaller quenching effect and the slower solidification of the ingot permit adjustment to a very high degree of purity of the base metal, because the base metal remains molten much longer, and the thermocurrent circulates it longer so that inclusion particles can rise thereby facilitating separation.

During an early stage following casting, the heat dissipation of the molten base metal can be accelerated by moistening and subsequently sprinkling the insulating material with water at the side sheets. Thus, the temperature of the base metal will be maintained in the range of the rolling temperature by the dry insulating material alone.

Prior to casting, charcoal or similar floatable substances may be added to the casting surface. These substances rise with the surface of the base metal and limit the upward heat radiation. Furthermore, these substances constitute a reducing atmosphere in the hollow body and bind oxidation and slag components, without affecting the composition of the base metal.

The thickness of the side plates 20 and 21 (plates 20 or 21 if only one is used) of cladding material is limited by the heat content of the charged molten base metal if rolling is to be effected by use of the casting heat. The side plates thereby obtain their rolling heat from the heat content of the base metal. Depending on the size of the ingots—ingot sizes of from 10 to 40 tons are desireable—a thickness of side plates 20 and 21 from 3 to 15% of the corresponding thickness of the slag is desireable.

Moreover, before casting, the inner surfaces of the hollow body including the cladding surfaces may be protected with a material having a high-melt characteristic which decomposes and burns only when wetted with the molten base metal. When top casting, a spray box will prevent scales from occurring.

Obviously, many other modifications and variations of the present invention are made possible in the light of the above teachings. It is therefore to be understood that within the scope of the appended claims the invention may be practiced otherwise than as specifically described.

What is claimed is:

1. In a method of fabricating clad metal ingots, more particularly clad slabs, comprising the steps of forming an upright tubular hollow body corresponding to the dimensions of the finished slab, said body being fomed by assembling together a pair of opposed metal side plates of cladding material of a predetermined thickness, and metal side sheets each of a thickness less than said predetermined thickness;

inserting said hollow body into an external ingot mold having side walls parallel to and spaced from said side plates and said side sheets and having a bottom wall parallel to and spaced from the bottom end of said body;

providing a quantity of fine-grained refractory insulating material in the space between said body and said mold; and then casting the finished slab by filling said hollow body with a molten base metal;

the improvement comprising the steps of, prior to inserting said body into said mold, sealing said bottom end of said body with a metal bottom wall united with said side plates and said side sheets; placing a metal cover on the top end of said body; providing an open filling gate in said cover plate through which the hollow body is filled with the base metal; seal welding said cover plate to said side plates and said side sheets prior to filling said hollow body with the base metal; and coating, before casting, the inner surface of said hollow body with a material having a high-melt characteristic which decomposes only when melted with the molten base metal, said bottom wall and said cover having a thickness substantially the same as the thickness of said side sheets; whereby, because of the seals between said side plates, said bottom wall and said cover, any gaps between said side plates of cladding material and the base metal after casting are inaccessible to the atmosphere thereby avoiding any oxidation at the interface thereof and further facilitating an improved bond between said side plates and the base metal during a subsequent rolling of the slab.

2. In a method of fabricating clad metal ingots, more particularly clad slabs, comprising the steps of forming an upright tubular hollow body corresponding to the dimensions of the finished slab, said body being formed by assembling together a pair of opposed metal side plates of cladding material of a predetermined thickness, and metal side sheets each of a thickness less than said predetermined thickness;

inserting said hollow body into an external ingot mold having side walls parallel to and spaced from said side plates and said side sheets and having a bottom wall parallel to and spaced from the bottom end of said body;

providing a quantity of fine-grained refractory insulating material in the space between said body and said mold; and then casting the finished slab by filling said hollow body with a molten base metal;

the improvement comprising the steps of, prior to inserting said body into said mold, sealing said bottom end of said body with a metal bottom wall united with said side plates and said side sheets; placing a metal cover on the top end of said body slightly below the top surface of the molten base metal following the filling of the body with the base metal, said cover having marginal edges spaced inwardly of said side plates and said side sheets so that molten base metal wells up through gaps thereby defined for sealing said cover to said plates and said sheets; and coating, before casting, the inner surface of said hollow body with a material having a high-melt characteristic which decomposes only when melted with the molten base metal, said bottom wall and said cover having a thickness substantially the same as the thickness of said side sheets; whereby, because of the seals between said side plates, said bottom wall and said cover, any gaps between said side plates of cladding material and the base metal are inaccessible to the atmosphere thereby avoiding any oxidation at the interface thereof and further facilitating an improved bond between said side plates and the base metal during a subsequent rolling of the slab.

3. The method according to claim 1, further comprising the step of providing a hood of insulating material over said cover plate thereby enabling said filling gate to be filled with the molten metal during the casting, and further thereby maintaining a portion of the base metal on top of said cover plate molten sufficiently long to permit the formation of a sink hole beneath said gate.

4. The method according to claim 1 or 2, wherein each said side plate of cladding material has a wall thickness of from 3 to 15%, preferably from 3 to 10%, of the corresponding thickness of the slab.

5. The method according to claim 1 or 2, wherein said side sheets have a wall thickness of from 0.2 to 2.0% of the largest cross-sectional side of the slab, and said side sheets being adapted to the superheat characteristics of the slab.

6. The method according to claim 1 or 2, further comprising the step of covering said top end of said body with refractory insulating material after said casting step.

7. The method according to claim 1 or 2, wherein said insulating material comprises one of a free-flowing sand, slag sand, fine clay and alumina, said material having a melting and sintering temperature in excess of 1800 K., and the thickness of said material ranging from 5 to 50% of the largest cross-sectional side of the slab.

8. The method according to claim 1 or 2, comprising the further steps of wetting said insulating material at said side sheets with water immediately after casting for accelerating heat dissipation through said side sheets, and maintaining the temperature of the slab in the range of a temperature necessary for rolling by the remaining dry insulating material alone.

9. The method according to claim 1 or 2, comprising the further step of preventing the outer surfaces of said hollow body from scaling by adding to said insulating material a quantity of fine coal of up to 1.0% by weight.

10. The method according to claim 1 or 2, comprising the further step of preventing the outer surfaces of said hollow body from scaling by covering an uppermost portion of said insulating material with carbonaceous insulating powders.

11. The method according to claim 1 or 2, wherein said step of providing said quantity of insulating material includes the further step of thermally insulating the refractory insulating material by lining the inner surface of said mold with a permanent insulating layer comprising one of lightweight refractory bricks and asbestos plates, and completely filling the space between said body and said mold with the refractory insulating material and the permanent insulating layer, whereby the base metal slowly chills thereby eliminating reheating for subsequent rolling, and further thereby facilitating a lowering of the casting temperature.

12. The method according to claim 11, comprising the further step of alloying the base metal in said hollow mold as facilitated by the slow chilling.

13. The method according to claim 1 or 2, comprising the further step of, prior to casting, adding floatable materials comprising charcoal to the casting surface to thereby limit the upward heat radiation of the molten metal during casting, to establish a reducing atmosphere in said hollow body, and to bind oxidation and slag components but without affecting the composition of the base metal.

14. In a method of fabricating clad metal ingots, more particularly clad slabs, comprising the steps of forming an upright tubular hollow body corresponding to the dimensions of the finished slab, said body being formed by assembling together a pair of opposed metal side plates of cladding material having a wall thickness of from 3–15% of the corresponding thickness of the slab, and metal side sheets each of a thickness of from 0.2–2.0% of the largest cross sectional side of the slab;

inserting said hollow body into an external ingot mold having side walls parallel to and spaced from said side plates and said side sheets and having a bottom wall parallel to and spaced from the bottom end of said body;

providing a quantity of fine-grained refractory insulating material in the space between said body and said mold; and casting the finished slab by filling said hollow body with a molten base metal;

the improvement comprising the steps of, prior to inserting said body into said mold, sealing said bottom end of said body with a metal bottom wall united with said side plates and said side sheets; placing a metal cover on the top end of said body; providing an open filling gate in said cover plate through which the hollow body is filled with the base metal; seal welding said cover plate to said side plates and said side sheets prior to filling said hollow body with the base metal; and coating, before casting, the inner surface of said hollow body with a material having a high-melt characteristic which decomposes only when melted with the molten base metal, said bottom wall and said cover having a thickness substantially the same as the thickness of said side sheets; whereby, because of the seals between said side plates, said bottom wall and said cover, any gaps between said side plates of cladding material and the base metal after casting are inaccessible to the atmosphere thereby avoiding any oxidation at the interface thereof and further facilitating an improved bond between said side plates and the base metal during a subsequent rolling of the slab.

* * * * *